United States Patent [19]

Kummerlen

[11] Patent Number: 4,886,172

[45] Date of Patent: Dec. 12, 1989

[54] CLOTHES HANGING STAND

[76] Inventor: Donald R. Kummerlen, 4241 NE. 26th Ter., Lighthouse Point, Fla. 33064

[21] Appl. No.: 223,921

[22] Filed: Jul. 25, 1988

[51] Int. Cl.[4] ..... A47F 5/08

[52] U.S. Cl. ..... 211/87; 211/105.1; 211/100

[58] Field of Search ..... 211/105.1, 123, 204, 211/104, 100, 96, 87

[56] References Cited

U.S. PATENT DOCUMENTS

| | | | |
|---|---|---|---|
| 328,926 | 10/1885 | Elliott | 211/104 X |
| 433,859 | 8/1890 | Foster | 211/100 X |
| 749,081 | 1/1904 | Mullen | 211/100 X |
| 1,511,179 | 10/1924 | Tallman | 211/104 X |
| 1,883,219 | 10/1932 | Wolf | 211/100 X |
| 2,433,275 | 12/1947 | Higby, Sr. | 211/104 |
| 2,875,903 | 3/1959 | Shourds | 211/100 |
| 4,252,242 | 2/1981 | Tudor | 211/104 X |

*Primary Examiner*—Sarah A. Lechok
*Attorney, Agent, or Firm*—Harry W. Barron

[57] ABSTRACT

A clothes hanging stand rests against a wall when not used and extends from the wall when used. The stand includes a base member, an arm affixed in a pibotally manner to the base member and a leg which includes a bracket that slides over the base member and the arm to a position to hold the arm in a horizontal position when in use. When not in use, the leg slides back against the base member and the arm pivots downward so that both rest in a side by side vertical position against the wall. The base member may be include a U shaped bracket and the arm is affixed using a wire bracket interlooped with to the U shape bracket. A leg bracket is attached to the leg permitting it to slide over the base bracket, the arm bracket and the arm from the position resting on the U shaped bracket. The U shape base bracket mechanism may include retaining bends therein for retaining the leg bracket when in the nonuse position.

13 Claims, 1 Drawing Sheet

CLOTHES HANGING STAND

This invention relates to a stand for hanging clothes and more particularly to such a stand which, when not in use, rest against a wall and, when in use, is easily and quickly connected to extend from the wall.

A specific need arises in the home for a convenient clothes drying rack which can be placed, for example, in a laundry room. Such a rack is typically used only when a person is laundering items which should not be placed in the dryer. For example, items made of nylon or other materials, which may be dmaged by the heat of the dryer, should to be hung to dry. In the past, people have typically moved such items from laundry room to a bathroom and hung the items over the shower rod.

Alternatively, a free standing clothes drying rack may be used, but first must be removed from a storage area and assembled. After using the free standing rack, it must be returned to the storage area. It would be preferable to have a clothes hanging stand which, when needed, can be quickly and easily set up in the laundry room and which, when no longer needed, can be quickly and easily disassembled to fit against a wall in the laundry room in an out of the way position. In addition, such a mechanism should be inexpensively constructed and easy to assemble and disassemble by the user.

It is well known in the prior art to attach a mechanism to a wall, which mechanism rests against the wall when not in use and which can be extended outward to provided a certain function. For example, fold down shelves and the like have been used for many years for this purpose. Other apparatus, which functions for the purpose of holding clothing and the like, may extend outward when used and rests against the wall when not in use. For example, such apparatus is shown in U.S. Pat. No. 4,323,162 in the name of Steinhilber, U.S. Pat. No. 3,417,874 in the name of Bryant, U.S. Pat. No. 4,252,242 in the name of Tudor, U.S. Pat. No. 2,875,903 in the name of Shourds, U.S. Pat. Nos. 2,816,668 and 4,029,211 in the name of Marshall and U.S. Pat. No. 4,611,721 in the name of Heckaman. All of the aforementioned patents utilizes complex mechanisms which are expensive and difficult to install on existing walls or which do not fit sufficiently close to the wall, so as to be out of the way when not in use.

In accordance with one aspect of this invention there is provided apparatus of the type extendable from a wall when in use and resting against such wall when not in use comprising a leg and an arm, a first securing member secured against the wall and a second securing member, affixed between one end of the arm and the first securing member, for pivotally securing the arm to the first securing member. In addition, there is provided a third securing member affixed to the leg and moveable around the first securing member, the second securing member and the arm from a nonuse position between the second securing member and the wall to a use position around the arm and remote from the one end so as to support the arm in a generally horizontal position.

One preferred embodiment of the subject invention is hereafter described, with specific reference being made to the following Figures, in which.

Figure 1:
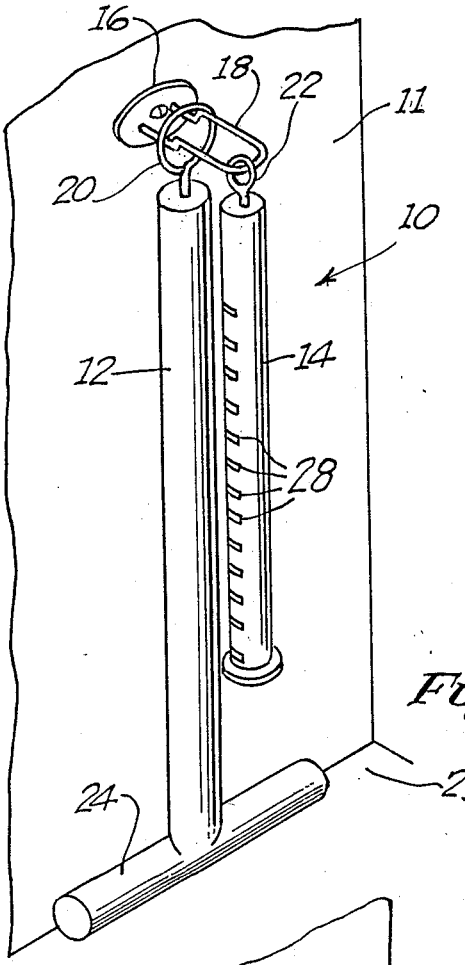
FIG. 1 show the inventive clothes hanging stand of the subject invention in a nonuse position.
Figure 2:
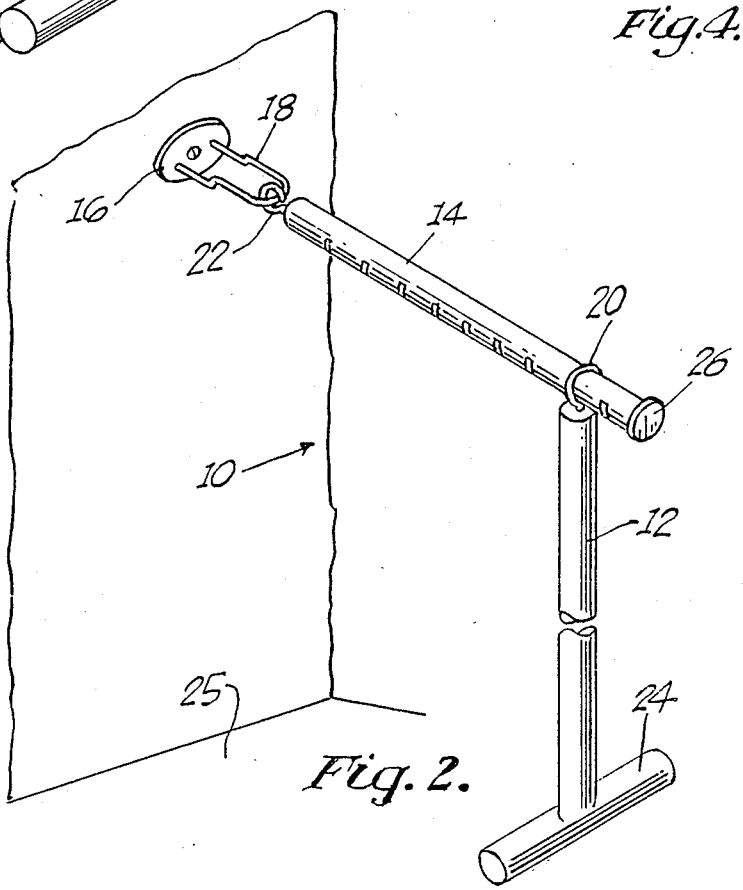
FIG. 2 shows the clothes hanging stand of the subject invention in a use position.

Referring now to FIGS. 1 and 2. FIG. 1 shows the clothes hanging stand 10 of the subject invention in the nonuse position resting against a wall 11 and FIG. 2 shows the clothes hanging stand 10 in the use position extending from wall 11. Stand 10 includes a leg 12 and arm 14 which are affixed to a base 16. Base 16 may be secured to a stud behind wall 11 using a screw or other similar fastening mechanism or may be secured between studs using a conventional anchor mechanism. As seen in FIG. 1, stand 10, when in the nonuse position is relatively close to the wall 11 so as not to interfere with passage through the area. Typically, wall 11 will be found in or near the laundry room or area where a clothes washer is located.

Leg 12 and arm 14 may be wooden quarter inch dowel rods or hollow half inch PVC pipe. Depending upon the length of arm 14, which is to be cut to fit within the desired area surrounding wall 11, arm 14 may be of a greater diameter than leg 12 in order to hold additional weight.

A base bracket 18, which may be U shaped, extends outward from base 16 by an amount sufficient to permit leg 12 and arm 14 to rest adjacent to one another while hanging from bracket 18. Leg 12 has a leg bracket 20 extending from one end thereof. Leg bracket 20 may be generally circular in shape and will have a diameter sufficient to enable it to slide over bracket and over arm 14. Arm 14 similarly has an arm bracket 22 affixed to one end thereof and which is attached to loop within bracket 18. Thus, arm 14 is pivotally attached to base 16 by looping bracket 22 within bracket 18 so that arm 14 may be raised from the vertical, or nonuse, position shown in FIG. 1, to the horizontal, or use, position shown in FIG. 2.

Leg 12 has a foot 24 attached to the end thereof opposite to the end which bracket 20 is attached. The length of leg 12, with foot 24 and bracket 20 attached thereto, relative to the position on wall 11 at which base 16 is affixed, is such that, relative to the position on wall 11 at which base 16 is affixed, when leg 12 is inserted over bracket 18 and resting in a downward position therefrom, foot 24 will not quite touch floor 25.

Arm 14 has a stop 26 attached to the end thereof opposite to the end thereof to which bracket 22 is attached which is sized to have a diameter greater than the diameter of bracket 20. Thus, bracket 20 is prevented from sliding off the end of arm 14. In addition, arm 14 has a series of space slots 28 cut therein sized to receive bracket 20 as it is slid over arm 14. When leg 12 is in the proper position away from wall 11, bracket 20 is placed into one of the slots 28 to prevent the further sliding if bracket 20 along arm 14.

Figure 3:
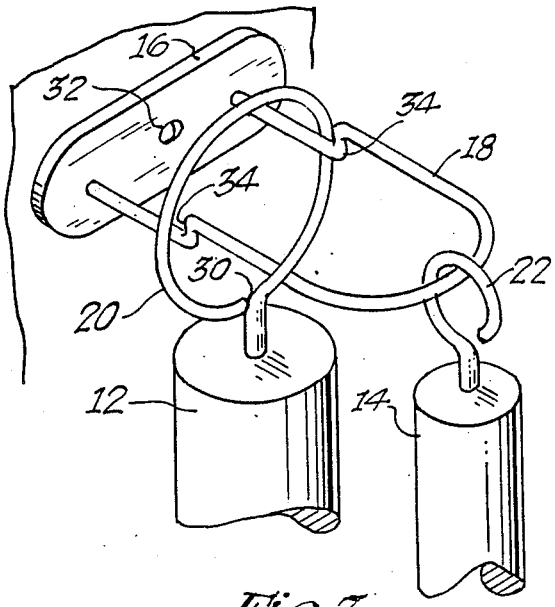
FIG. 3 is an enlarged and detail view of the various elements of the subject of invention when in the nonuse position.

When it is desired to use clothes hanging stand 10 for the purpose of hanging clothes thereon, it is extended to the configuration shown in FIG. 2. Specifically, arm 14 is rotated to a slightly above horizontal position and bracket 20, holding leg 12, is slid over bracket 18, bracket 22 and the outside of arm 14 to the desired position away from wall 11. At that point, the bottom 30 of bracket 20, which is best seen in FIG. 3, is inserted into one of the slots 28. This prevent further lateral movement of bracket 20 over arm 14. When foot 24 is permitted to rest on floor 25, arm 14 is at a generally horizontal level.

When it is desired to discontinue the use of clothes hanging stand 10, the opposite procedure is undertaken, that is, bracket 20 is removed from slot 28 and slid back over arm 14, bracket 22 and bracket 18 to rest at the back side of bracket 18. At the same time, arm 14 is allowed to fall to a vertical position, as seen in FIG. 1.

Referring now to FIG. 3, the detail construction of the various components of the clothes hanging stand 10 will now be described. Base 16 may be a wood or plastic member sufficiently large so that bracket 18 may be securely affixed thereto. Base 16, as previously mentioned, is secured to wall 11 by a fastener 32, which may be a wood screw or conventional hollow wall type fastener.

Base bracket 18 may be of a generally U shaped with the open U side leg ends being affixed to base 16 and the closed U end extending outward from base 16. Bracket 18 may be constructed of a strong heavy gauged wire, such as stainless steel and each of the U legs of bracket 18 may include a retaining bend 34 therein adapted to retain bracket 20, when it is positioned in the nonuse position, as shown in FIG. 3. The distance separating each of the U legs of bracket 18 should be not greater than the diameter of arm 14 and the length from base 16 to the closed end of the U should be slightly more than the sum of the diameter of leg 12 and the radius of arm 14. This length must be a minimum of the diameter of leg 12 plus the radius (one half of the diameter) of arm 14 in order to permit arm 14 and leg 12 to rest vertically in the nonuse position as seen in FIGS. 1 and 3. The position of retaining bends 34 should be selected to be at least one half of the diameter of leg 12 from base 16.

Arm bracket 22 may be an open or closed loop type bracket one end of which is affixed to an end of arm 14. Bracket 22 is looped within bracket 18 so as to provide a pivoting connection between arm 14 and bracket 18. The width bracket 22 should be approximately the as the diameter of arm 14 so that bracket 20 may slide over bracket 22 when stand 10 is assembled in the use position. Bracket 22 should be constructed of a strong wire materials, such as stainless steel, and the strength of brackets 18 and 22 should be sufficient to hold damp clothing on arm 14 when stand 10 is in the use position, as shown in FIGS. 2 and 4.

Leg bracket 20 may be generally circular in shape and is affixed to an end of leg 12. Bracket 20 again may be a strong stainless steel wire material. Both brackets 20 and 22 are affixed to respective leg 12 and arm 14 by being for example, screwed into an end thereof or a bolted to an end plate in a conventional manner. The diameter of bracket 20 should be greater than the distance separating the U legs of bracket 18, the diameter of brackets 22 and the diameter of arm 14 in order that it may slide easily over those components from the nonuse position to the use position. When in the nonuse position, bracket 20 should be positioned on the base side of retaining bends 34 to avoid sliding off bracket 18. While leg 12 and arm 14 have been described above as preferably being round, they, of course, may assume any cross-sectional shape, and the shape of the inner area of bracket 20 may be changed to permit it to slide over arm 14 and brackets 18 and 22.

Figure 4:
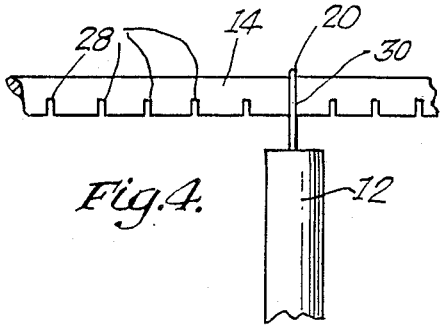
FIG. 4 is an enlarged and detailed view of the manner in which certain of the elements of the subject invention cooperate when in the use position.

Referring now to FIG. 4, the manner in which slots 28 cooperate with bracket 20 in the use position is shown. Each of the slots 18 may simply be grooves cut in the bottom of arm 14. The grooves may only be in that portion of arm 14 where leg 12 is to be positioned during the use, that is away from the end of arm 14 to which bracket 22 is affixed. Each of the slots 28 should be of a sufficient width to permit the bottom 30 of bracket 20 to be inserted therein when leg 12 has reached the proper distance away from wall 11. An alternative to cutting slots 28 in arm 14 would be to provide fastener means in association with bracket 20 to lock it in place at a particular location along the length of arm 14.

The inventive concept as described above is the ability of bracket 20 holding leg 12 to slide over both the base bracket 18 the arm bracket 22 and the arm 14. While the detail of wire brackets have been shown other mechanisms meeting the criteria may also be used. For example, bracket 18 could be replaced by a post and bracket 22 could be replaced by a hinge affixed between arm 14 and the post. The criteria required to be met would be that the post and hinge be smaller in size than the interior shape of bracket 20.

What is claimed is:

1. Hanging apparatus of a type extendable from a wall when in use and resting against said wall when not used comprising:

a leg and an arm;

a first securing member secured against said wall;

a second securing member affixed between one end of said arm and said first securing member for pivotally securing said arm to said first securing member; and a third securing member affixed to said leg and movable around said first securing member, said second securing member and said arm from a nonuse position between said second securing member and said wall to a use position around said arm remote from the one end so as to support said arm in a generally horizontal position.

2. The invention according to claim 1 wherein said first securing member is U shaped and has a dimension between the legs thereof substantially the same as the corresponding direction dimension of said arm.

3. The invention according to claim 2 wherein said first securing member has a depth greater than one cross sectional dimension of said leg plus one half of one cross-sectional area of said arm.

4. The invention according to claim 2 wherein said first securing member includes a support area for said third securing member.

5. The invention according to claim 1 wherein said first securing member includes a support area for said third securing member.

6. The invention according to claim 1 wherein said arm includes means to interact with said third securing member to prevent movement of said third securing member when said third securing member is in said use position.

7. A clothes hanging stand of a type which rests closely against a wall when not in use and which extends from said wall when in use comprising:

a first bracket affixed to said wall a first distance above the floor, said first bracket including an extending member positioned in a direction away from said wall;

a first support member;

a second support member having a length of approximately said first distance;

a first securing member affixed to said first support member for pivotally securing said first support member to said extending member; and a second securing member, affixed to one end of said second support member, said second securing member being of a closed loop shape sized to slide over said extending member, said first securing member and said first support member.

8. The invention according to claim 7 wherein said extending member includes means to retain said second securing member.

9. The invention according to claim 7:

wherein said first support member is cylindrical in shape and has a first diameter;

wherein said first securing member has a width of no greater than said first diameter; and wherein said second securing member is circular and has an inner diameter greater than said first diameter.

10. The invention according to claim 9 wherein said extending member has a maximum diameter normal to the direction of extension less than the inner diameter of said second securing member.

11. The invention according to claim 10 wherein said extending member includes means to retain said second securing member.

12. The invention according to claim 9 wherein said extending member includes a U shaped bracket.

13. The invention according to claim 7 wherein said first support member includes means to interact with said second securing member to prevent movement of said second securing member when said second securing member is positioned after being slid over said first support member.

* * * * *